United States Patent [19]

Foreman

[11] 4,009,112

[45] Feb. 22, 1977

[54] PELLETIZED RECTIFIER FOR MOLTEN NEUTRAL SALT BATHS AND METHOD

[75] Inventor: Robert W. Foreman, Bloomfield Hills, Mich.

[73] Assignee: Park Chemical Co., Detroit, Mich.

[22] Filed: Sept. 5, 1975

[21] Appl. No.: 610,619

[52] U.S. Cl. ..... 252/71; 252/75

[51] Int. Cl.[2] ..... C09K 3/00; C21D 1/00

[58] Field of Search ..... 252/71, 75; 148/15, 148/15.5, 22, 27, 28

[56] References Cited

UNITED STATES PATENTS

| | | | |
|---|---|---|---|
| 2,394,777 | 2/1946 | Holden et al. | 252/71 |
| 2,431,479 | 11/1947 | Holden | 252/71 |
| 2,474,680 | 6/1949 | Kramer | 252/71 X |
| 2,495,471 | 1/1950 | Newell | 252/71 |
| 2,510,650 | 6/1950 | Newell | 252/71 |
| 2,542,637 | 2/1951 | DePoy | 252/71 X |
| 2,575,322 | 11/1951 | Case | 252/75 |
| 2,793,147 | 5/1957 | Erdmann et al. | 252/71 X |
| 2,851,420 | 9/1958 | Holden | 252/71 |

*Primary Examiner*—Harris A. Pitlick
*Attorney, Agent, or Firm*—Harness, Dickey & Pierce

[57] ABSTRACT

Addition of special thermally decomposable chloro compounds intimately mixed and pelleted or briquetted with a neutral binder material is made to molten neutral salt baths to restore neutrality by converting oxides of the alkali/alkaline earth metals back to chlorides and dispelling the remainder of the compound as a vapor.

8 Claims, No Drawings

PELLETIZED RECTIFIER FOR MOLTEN NEUTRAL SALT BATHS AND METHOD

BACKGROUND OF THE INVENTION

This invention broadly relates to non-sludge forming solid neutral salt rectifiers. More particularly this invention relates to a new and novel pelletized product which is used to rectify molten neutral salt baths; and, to a method of rectifying such salt baths.

The state of the art is indicated by the following references which are cited here for the record and the disclosures of which are incorporated herein by reference: U.S. Pat. Nos. 2,474,680; 808,911 issued Jan. 2, 1906; 278,250 issued May 22, 1883; 2,851,240 issued Sept. 9, 1958; 2,738,294 issued Mar. 13, 1956; 2,793,147 issued May 21, 1957; 2,931,778 issued Apr. 5, 1960; and, an article entitled "Prevention of Decarburization in Fused Barium and Sodium Chloride Salt Baths" by W. P. Wood and Toy Shigekha, University of Michigan, 1947.

The use of methyl chloride for neutral salt rectification is mechanically involved, inefficient, and somewhat hazardous. See for example U.S. Pat. No. 2,474,680 which deals with methyl chloride rectification. Also methyl chloride has been in short supply at times and the need for a non-sludge forming, low cost, solid rectifier technique has been recognized in the last several years. Such a rectifier to be effective and practical should be one which can be readily used on a commercial basis and which would be more efficient than methyl chloride, and one which would be usable at operating temperatures up to about 2200° F.

Accordingly, it is an object of this invention to provide a new solid rectifier system for molten neutral salt baths.

Another object of the invention is to provide a novel method of rectifying molten neutral salt baths.

Another object of the invention is to provide a new pelletized product which can be introduced into a molten neutral salt bath and which will act to rectify same in an efficient and highly advantageous manner.

Other objects, features and advantages of the present invention will become apparent from the subsequent description and the appended claims.

SUMMARY OF THE INVENTION

Briefly stated, the present invention is concerned with a pellet product means for rectifying molten neutral salt baths, and being made from a composition comprised of in weight percent, (a) about ½% to about 75% of a solid nitrogen containing compound that yields HCl upon thermal degradation, (b) about 25% to about 99½% of at least one non-alkaline neutral binder material means for maintaining said product in a generally pellet form, said molten neutral salt baths being of the type which are generally maintained at a temperature between about 1300° F. and 2300° F., said pellet product means being capable of acting as a generally non-sludge forming rectifier when introduced into a molten neutral salt bath and acting to rectify undesirable materials such as oxides which tend to form in the neutral salt baths, and said pellet product means being operative to dissolve in the neutral salt bath after being introduced therein.

From a method aspect, briefly stated, this invention concerns rectifying said salt baths by introducing the pellet product into the baths as more fully described hereinbelow.

While the theory which underlies the operation of the invention discovered and disclosed herein is not fully understood, it has been found that a very highly advantageous rectifier product can be made using for example solid ammonium chloride combined with a neutral binder material (preferably a solid salt material such as sodium chloride, potassium chloride and/or barium chloride) made up into the form of a pellet. When this pellet is introduced into a molten neutral salt bath, which normally are mixtures of sodium chloride, potassium chloride and/or barium chloride, maintained at a temperature somewhere between the range of about 1300° – 2250° F., a unique rectification is carried out wherein the neutrality of the bath is restored due to the fact that the pellet product converts the oxides of the alkali or alkaline earth metals back to chlorides and dispels the remainder of the compound as a vapor. Yet on the other hand a material such as ammonium chloride per se when introduced into such a salt bath by itself will not carry out such a rectification. Thus unexpectedly it has been found that the pelletized form of the product as discovered and disclosed herein will provide a unique rectification technique for such molten neutral salt baths.

As used herein the term pellet or pelletized, is meant to include a generally round, square, rectangularly, or generally pill-shaped object which can be picked up by the hand and which can be introduced manually or mechanically into a molten neutral salt bath. It should be understood that the specific shape of the pellet or pill-shaped product made in accordance with this invention is not critical to the operation thereof.

DESCRIPTION OF PREFERRED EMBODIMENTS

As referred to above this invention deals with a new rectifier technique based preferably on a pellet which contains solid ammonium chloride combined with a neutral binder material. This rectifier in pellet form is approximately 80–95% efficient in its chemical reaction with the oxides in a molten neutral salt bath. This pellet product is easy to use and essentially it does not form any sludge and it can be used up to a temperature of about 2200° – 2300° F. The pellets in accordance with this invention should generally contain about 2 oz. of composition material from which they are made for rectification of normal baths and larger amounts should generally be used for pre-heat and high-heat salt baths.

In order to further illustrate the invention the following examples are provided, it is to be understood however that the examples are included for illustrative purposes and are not intended to be limiting of the scope of the invention as set forth in the subjoined claims.

EXAMPLE 1

A pellet product is formed from 37½% by weight sodium chloride, 37½% by weight potassium chloride and 25% by weight ammonium chloride. This pellet is introduced into a molten neutral salt bath which is maintained at a temperature of approximately 1500° F. and the rectification of the oxides in the bath is highly satisfactory.

EXAMPLE 2

A pellet product is formed from 22½% sodium chloride, 52½% barium chloride and 25% by weight ammonium chloride. This pellet product is introduced into a molten neutral salt bath which is maintained at a temperature of approximately 1700° F. and the rectification of this salt bath is highly satisfactory.

EXAMPLE 3

A pellet product is made from a composition comprised of 25% by weight ammonium chloride and 75% by weight barium chloride. This pellet product is introduced into a molten neutral salt bath which is maintained at a temperature of approximately 2000° F. and the rectification of the oxide impurities in this bath is highly satisfactory.

On a preferred basis the solid nitrogen containing compound that yields HCl upon thermal degradation should be present within the preferred range of about 5% to about 35% by weight of the composition. Preferred materials for this use are ammonium chloride, and amino chloride type material, a chlorinated wax, pentachlorophenol, polyvinylchloride, trichloroacetamide, and hydrazinium chloride. The best material for this purpose is ammonium chloride.

On a preferred basis the non-alkaline neutral binder material should be present in the composition within the range of about 65% to about 95% by weight of the composition. The preferred material for this purpose is selected from the group consisting of an alkali metal and alkaline earth metal chlorides, fluorides and bromides. The best materials for this purpose are sodium chloride, potassium chloride, barium chloride and calcium chloride.

On a preferred basis the pellet product means used herein should be dissolvable within the salt bath within a time period of about 1 to 45 minutes.

While it will be apparent that the preferred embodiments of the invention disclosed are well calculated to fulfill the objects above stated it would be appreciated that the invention is susceptible to modification, variation and change without departing from the proper scope or fair meaning of the subjoined claims.

What is claimed is:

1. A pellet product means for rectifying molten neutral salt baths and being made from a composition comprised of in weight percent, a. about ½% to about 75% of ammonium chloride, and, b. about 25% to about 99½% of at least one nonalkaline neutral binder material means for maintaining said product in a generally pellet form, said material being selected from at least one of the group consisting of alkali metal and alkaline earth metal chlorides, fluorides, and bromides.

2. The invention of claim 1 wherein, said part (a) is present from about 5% to about 35% said part (b) is present from about 65% to about 95%.

3. The invention of claim 1 wherein, said pellet product means dissolves within about 1 to about 45 minutes.

4. The invention of claim 1 wherein, said part (b) is at least one material selected from the group consisting of, sodium chloride, potassium chloride, barium chloride, and calcium chloride.

5. A method of rectifying molten neutral salt baths comprising introducing into said bath a pellet product means for rectifying molten neutral salt baths and being made from a composition comprised of in weight percent, a. about ½% to about 75% of ammonium chloride to yield HCl upon thermal degradation, b. about 25% to about 99½% of at least one non-alkaline neutral binder material means for maintaining said product in a generally pellet form, said material being selected from at least one of the group consisting of alkali metal and alkaline earth metal chlorides, fluorides, and bromides, said molten neutral salt baths being of the type which are generally maintained at a temperature between about 1300° F. and 2300° F., said pellet product means being capable of acting as a generally non-sludge forming rectifier when introduced into a molten neutral salt bath and acting to rectify undesirable materials of the oxides type which tend to form in the neutral salt bath, and said pellet product means being operative to dissolve in the neutral salt bath after being introduced therein.

6. The invention of claim 5 wherein, said part (a) is present from about 5% to about 35%, said part (b) is present from about 65% to about 95%.

7. The invention of claim 5 wherein, said pellet product means dissolves within about 1 to about 45 minutes.

8. The invention of claim 5 wherein, said part (b) is at least one material selected from the group consisting of, sodium chloride, potassium chloride, barium chloride, and calcium chloride.

* * * * *